US006450575B1

(12) United States Patent
Liu

(10) Patent No.: US 6,450,575 B1
(45) Date of Patent: Sep. 17, 2002

(54) DETACHABLE STACKING CHAIRS

(76) Inventor: Lausan Chung-Hsin Liu, No. 243, Chein-Kuo Rd., Hsin-Tien City, Taipei Hsien (TW)

( * ) Notice: Subject to any disclaimer, the term of this patent is extended or adjusted under 35 U.S.C. 154(b) by 25 days.

(21) Appl. No.: 09/908,580

(22) Filed: Jul. 20, 2001

(51) Int. Cl.[7] ..... A47C 3/04

(52) U.S. Cl. ..... 297/239; 297/440.1; 297/445.1; 297/440.21

(58) Field of Search ..... 297/239, 440.1, 297/440.15, 440.14, 440.19, 451.1, 445.1, 446.2, 448.1

(56) References Cited

U.S. PATENT DOCUMENTS 3,624,814 A * 11/1971 Borichevsky ..... 297/452
4,750,784 A * 6/1988 Schwartz ..... 297/444
4,966,415 A * 10/1990 Schwartz et al. ..... 297/445
5,094,507 A * 3/1992 Gibbs ..... 297/239
5,120,110 A * 6/1992 Tseng ..... 297/445
5,449,220 A * 9/1995 Taylor et al. ..... 297/344.15

* cited by examiner

*Primary Examiner*—Anthony D. Barfield
*Assistant Examiner*—Stephanie Harris

(57) ABSTRACT

A detachable stacking chair includes a chair bracket for seating people and two front legs fastened to two sides of the chair bracket having respectively first fastening sections and second fastening sections formed thereon, and a pair of rear legs having first anchor sections and second anchor sections located thereon matching respectively the first fastening sections and the second fastening sections. The first anchor sections and the second anchor sections may be fastened respectively to the first fastening sections and the second fastening sections through first and second fasteners to compete a chair. The rear legs are detachable from the chair bracket and the front legs for stacking separately to save storing space.

2 Claims, 5 Drawing Sheets

PRIOR ART Fig. 1

DETACHABLE STACKING CHAIRS

BACKGROUND OF THE INVENTION

The present invention relates to detachable stacking chairs and particularly a chair that has detachable rear legs and a chair bracket for stacking separately to save storing space.

A wide variety of chairs are available on the market place these days. Conventional chairs usually have orthodox and angular designs. Whereas, the designs and shapes of the contemporary chairs tend to be singular and exotic to cater a wide spectrum of consumers' tastes. Many people are living in the crowd cities and restrictive resident environments. A lot of families have very limited living space, and have to prepare extra chairs for visiting relatives and friends, and to put away the chairs when not in use. Hence to reduce the storing size of the products to better utilize house space is critical. As a result, to make the products multi-functional and to make space utilization more flexible are the prevailing design trends nowadays.

FIG. 1 shows a conventional fixedly constructed chair which includes a back frame extending to form rear legs, a seat frame and front legs extending to form armrests. In order to make the chair firm and sturdy, the elements are generally fastened by soldering. As a result, the chairs are difficult to stack one upon another whatever their shapes and forms. Hence they usually occupy a lot of space, and transportation costs are high and becomes a heavy burden to the producers. Too much space requirement also creates a lot of problems for users. To achieve stacking effect, some chairs have reserve selected space between the seat frame and armrests to allow the rear legs to slip in. Nevertheless, as shown in the drawing, the chairs still cannot be stacked closely and ample space still needed. Moreover, such a design has to shrink the size of the seat frame or increase the total size of the chair. Production costs will also become higher. In addition, during stacking the chairs, the pointed ends of the legs could scratch and damage the coating of the seat frame or back frame of the chair located at the lower position and result in spoiling the appearance of the chair. It impairs the design object of good appearance.

SUMMARY OF THE INVENTION

The primary object of the invention is to resolve the foregoing disadvantages. The invention provides a set of rear legs detachable from a chair bracket and front legs such that they may be stacked separately to save storing space of the chairs. The chair bracket and two front legs fastened to two sides of the chair bracket have respectively first and second fastening sections. The two rear legs have first and second anchor sections matching and fastenable to the first and second fastening sections through first and second fasteners so that the rear legs may be fastened to the chair bracket and front legs to complete the chair.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1:
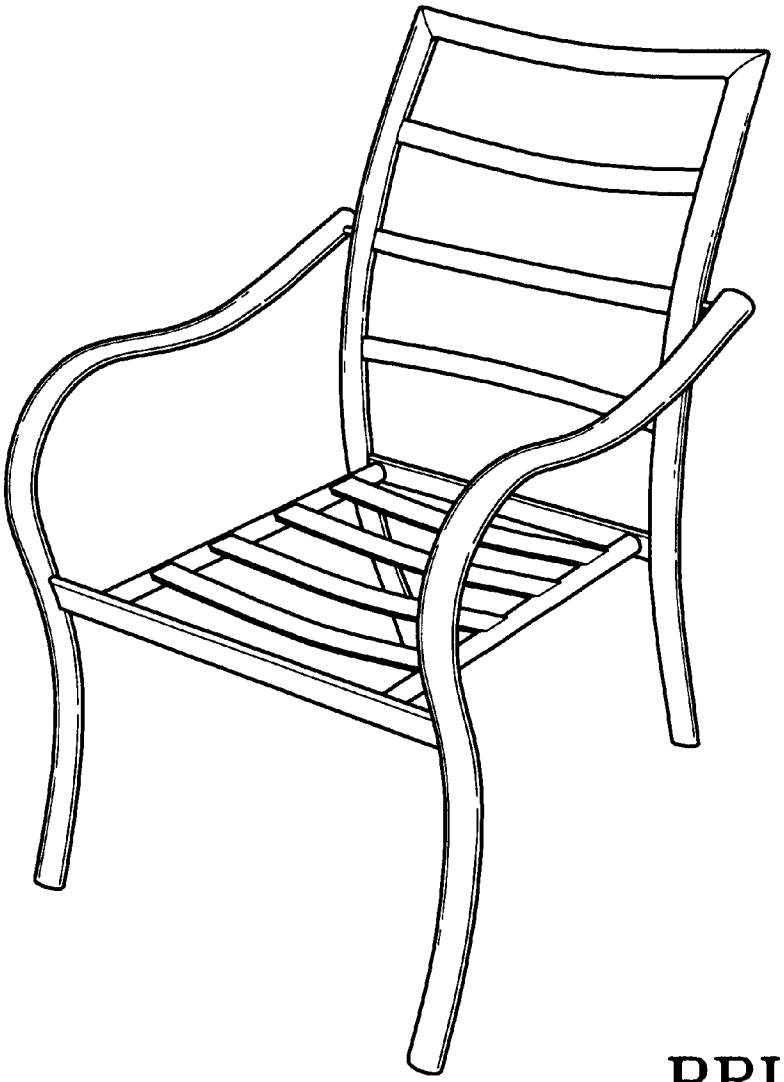
FIG. 1 is a schematic view of a conventional stacking chair.
Figure 2:
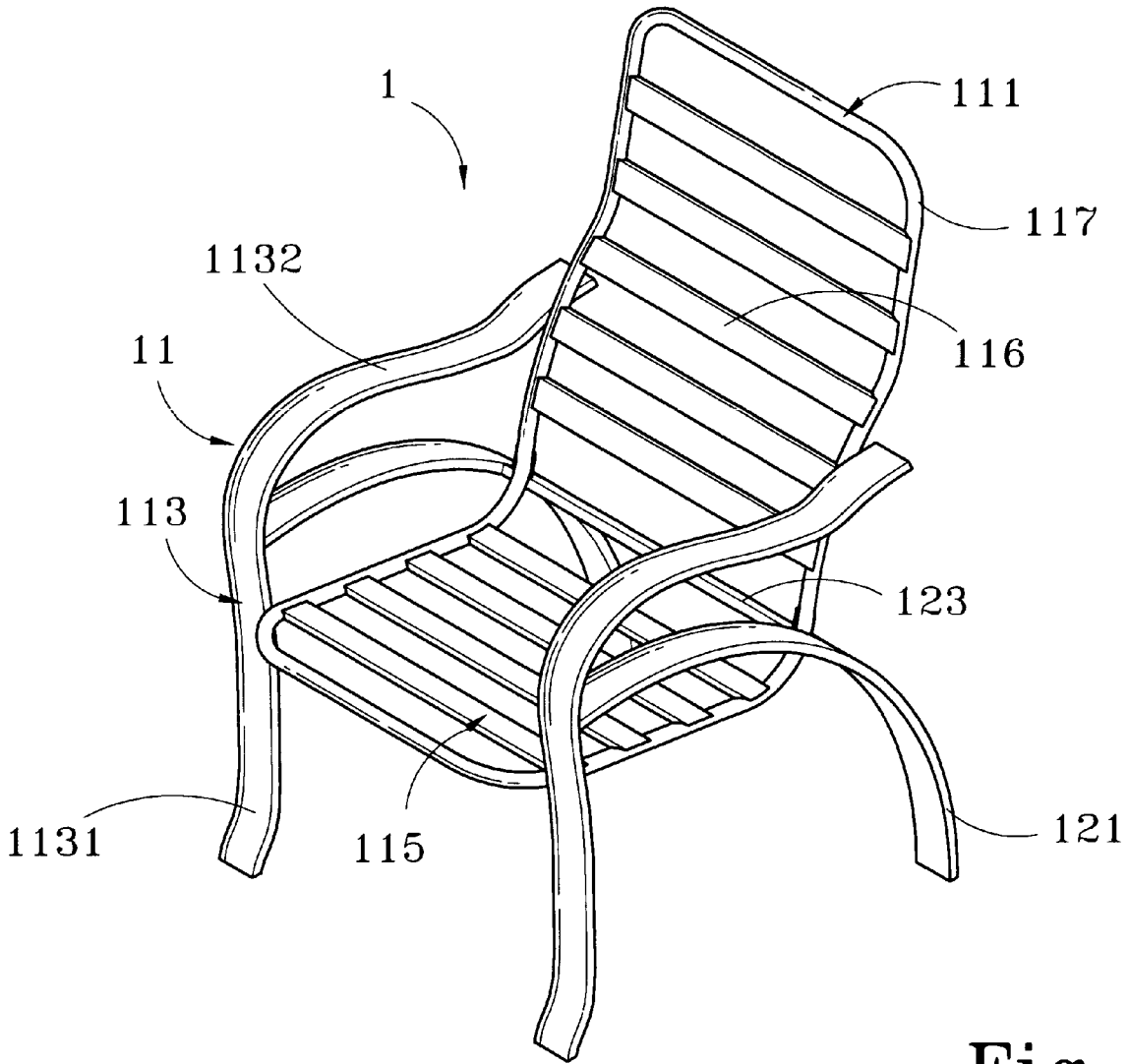
FIG. 2 is a perspective view of the invention.
Figure 3:
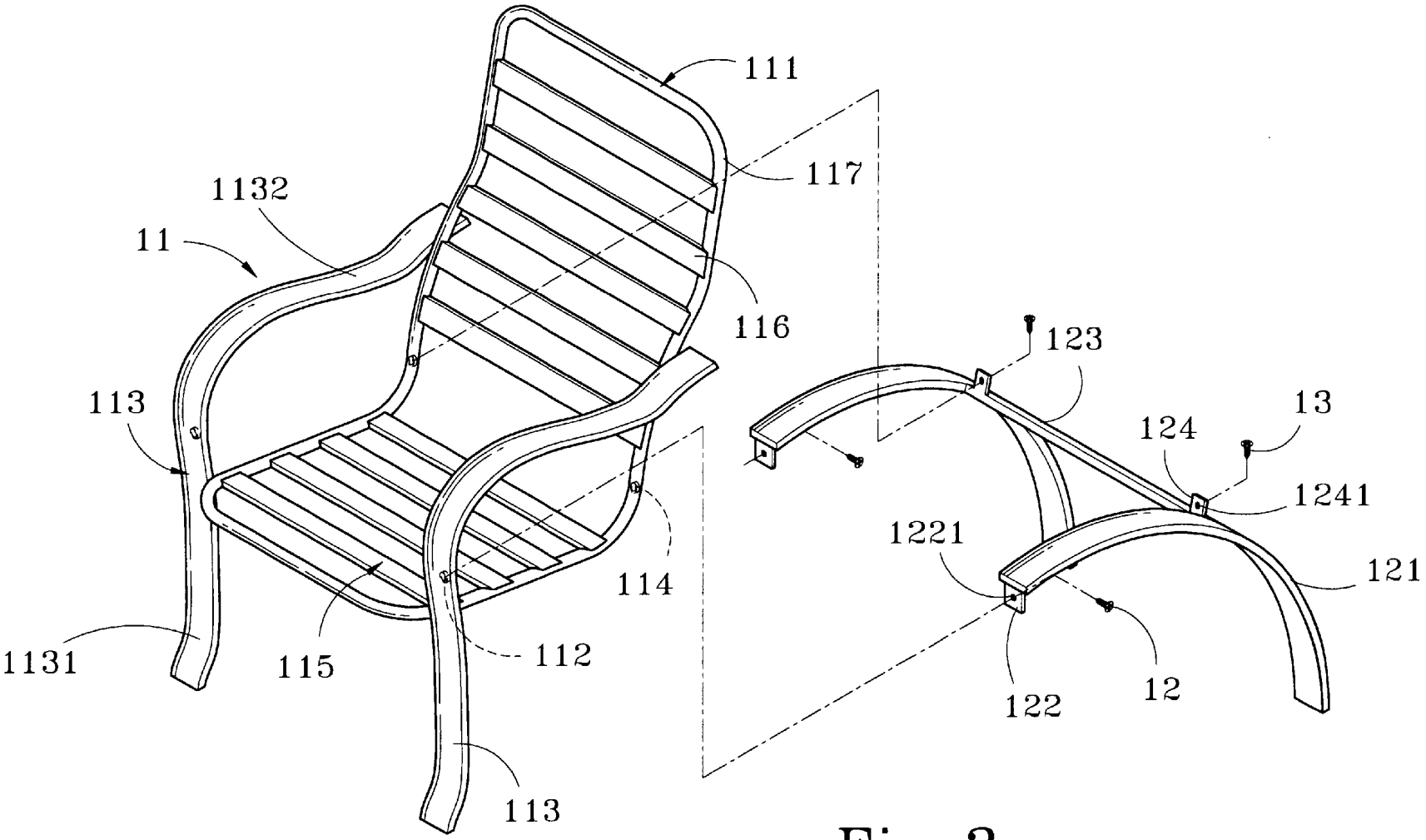
FIG. 3 is an exploded view of the invention.

Referring to FIGS. 2 and 3, the chair 1 of the invention includes a chair bracket 11 for seating people and two front legs 113 fastened to two sides thereof with first fastening sections 112 and second fastening sections 114 formed respectively on the front legs 113 and the chair bracket 11, and two rear legs 121 having first anchor sections 122 and second anchor sections 124 matching and fastenable respectively to the first and second fastening section 112 and 114 by means of first and second fasteners 12 and 13. The rear legs 121 may be detached from the chair bracket 11 and front legs 113 such that the separated rear legs 121 may be stacked together, and the separated chair bracket 11 and front legs 113 may also be stacked for saving space.

The chair bracket 11 includes a frame 117 with a plurality of beams 116 fastening thereon. The frame 117 is bent to form a seat section 115 and a backrest 111. Each front leg 113 includes a support section 1131 fastening to the seat section 115 and an armrest 1132 bending upwards and extending rearwards from the support section 1131 for soldering to the backrest 111. Each rear leg 121 has a front end integrally bent and extended to form the first anchor section 122 which has a first aperture 1221 formed thereon to match the first fastening section 112. There is a rear support rod 123 bridging the two rear legs 121 at the bending section of the chair bracket 11 to provide a stronger loading support. The rear support rod 123 has the two jutting second anchor sections 124 located thereon to match the second fastening section 114. Each second anchor section 124 has a second aperture 1241 formed thereon. The first and second aperture 1221 and 1241 are screw bores with internal screw threads. The first and second fasteners 12 and 13 are screws with external screw threads.

Figure 4:
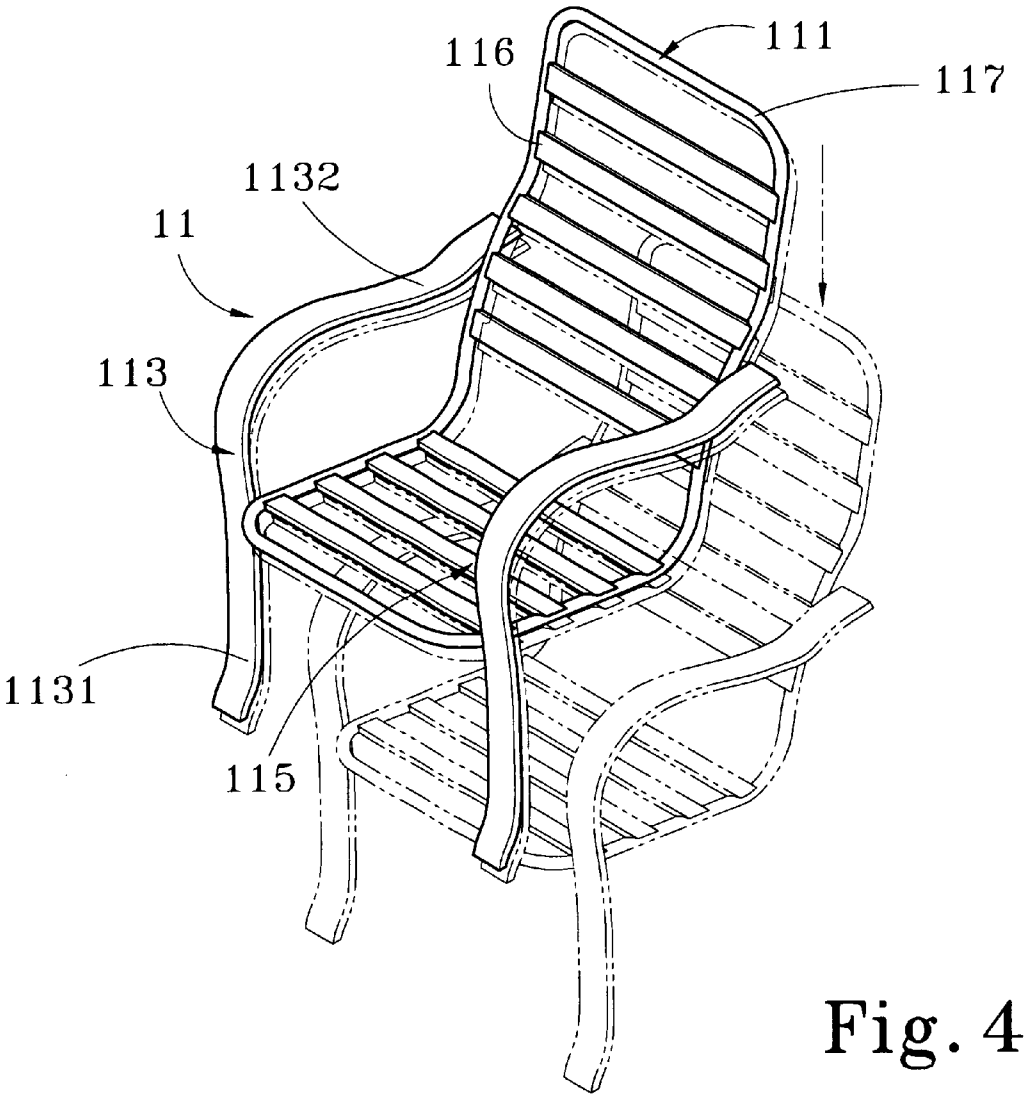
FIG. 4 is a schematic view of a chair bracket of the invention under stacking.
Figure 5:
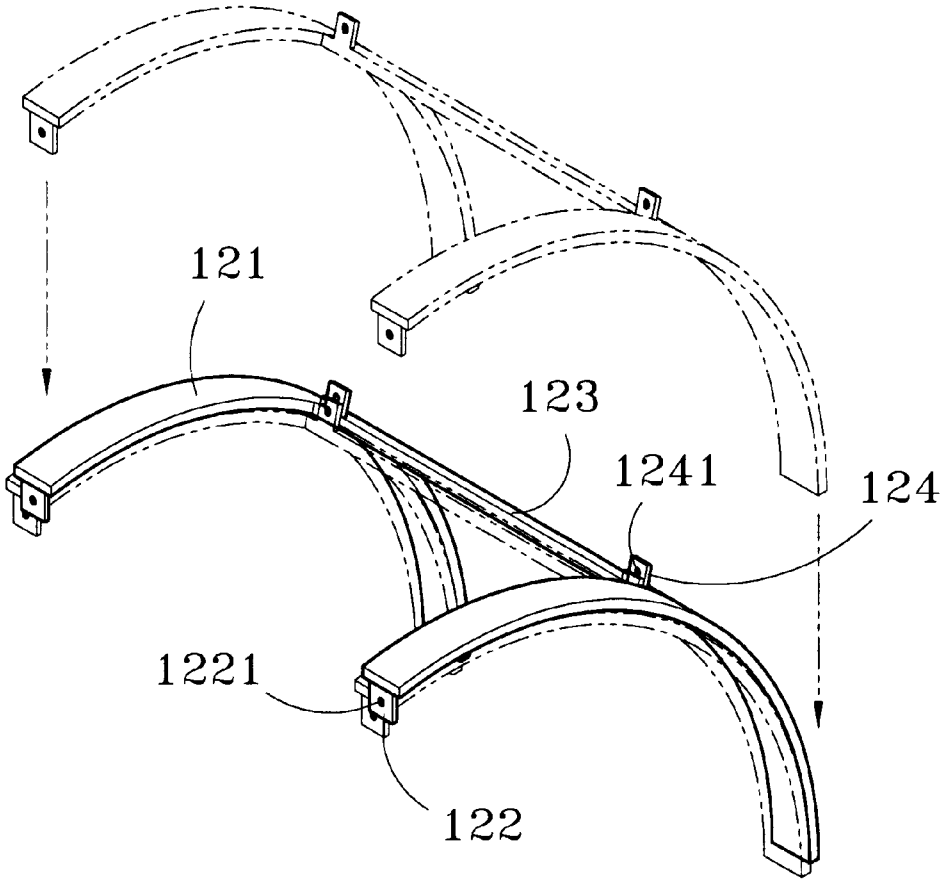
FIG. 5 is a schematic view of the rear legs of the invention under stacking.

Referring to FIGS. 4 and 5, the first and second fasteners 12 and 13 may be loosened and disengaged from the first and second fastening section 112 and 114, and the first and second apertures 1221 and 1241 to separate the rear legs 121 from the chair bracket 11 and front legs 113. Then the chair bracket 11 and front legs 113 may be stacked separately, while the rear legs 121 may also be stacked separately. Finally, the stacked rear legs 121 may be placed over the seat section 115. Hence the size of the chairs can be greatly decreased to reduce transportation costs for the producers. And users may also save a lot of storing space.

While the preferred embodiment of the invention has been set forth for the purpose of disclosure, modifications of the disclosed embodiment of the invention as well as other embodiment thereof may occur to those skilled in the art. Accordingly, the appended claims are intended to cover all embodiments which do not depart from the spirit and scope of the invention.

What is claimed is:

1. A detachable stacking chair comprising:

a) a chair bracket for seating people, the chair bracket including a pair of sides, a front leg secured to each side, each front leg having a first fastening section, the chair bracket having a pair of second fastening sections;

b) a pair of rear legs, each rear leg having a first anchor section defined by a front end of the rear leg being integrally bent and extended, the first anchor section having a first fastener aperture corresponding to each first fastening section;

c) a support rod bridging the rear legs, the support rod including a pair ofjutting second anchor sections, each second anchor section having a second fastener aperture corresponding to each second fastening section; and d) a first fastener engagable between each first fastening section and each first anchor section, and a second fastener engagable between each second fastening section and each second anchor section for detachably securing the rear legs to the front legs and chair bracket and forming the completed chair.

2. The detachable stacking chair of claim 1 wherein each of the first and second fastening apertures having an internal screw thread and each first and second fastener being a screw.

* * * * *